United States Patent [19]

Stange

[11] Patent Number: 4,568,174

[45] Date of Patent: Feb. 4, 1986

[54] PHOTORECEPTOR DESCUMMING DEVICE

[75] Inventor: Klaus K. Stange, Pittsford, N.Y.

[73] Assignee: Xerox Corporation, Stamford, Conn.

[21] Appl. No.: 584,037

[22] Filed: Feb. 27, 1984

[51] Int. Cl.[4] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 2,832,977 | 5/1958 | Walkup et al. | 15/1.5 |
| 3,099,856 | 8/1963 | Eichorn et al. | 355/15 X |
| 3,190,198 | 6/1965 | Eichorn | 355/15 |
| 3,278,972 | 10/1966 | Hudson | 15/308 |
| 3,552,850 | 1/1971 | Royka et al. | 355/15 |
| 3,615,397 | 10/1971 | Dimond | 96/1.4 |
| 3,672,764 | 6/1972 | Hartwig et al. | 355/3 R X |
| 3,775,102 | 11/1973 | Punnett | 355/3 R X |
| 3,781,107 | 12/1973 | Ruhland | 355/15 |
| 3,807,853 | 4/1974 | Hudson | 355/15 |
| 3,848,993 | 11/1974 | Hasiotis | 355/15 |
| 4,110,035 | 9/1978 | Kamata | 355/15 |
| 4,174,172 | 11/1979 | Lane | 355/15 |
| 4,230,406 | 10/1980 | Klett | 355/15 |

*Primary Examiner*—Fred L. Braun

*Attorney, Agent, or Firm*—Ronald P. Chapuran

[57] ABSTRACT

An apparatus for cleaning contaminants from a photoreceptor surface including a pivot for moving a flexible web into engagement with the photoreceptor surface. A supply station stores an unused portion of the web and a receiving station accepts the used portions of the web having contaminants thereon removed from the photoreceptor surface. The web is advanced from the supply station to the receiving station in order that successive portions of the web engage the photoreceptor surface. The pivot moves the cleaning web into engagement with the photoreceptor surface upon operator activation and automatically after a given time period out of engagement after a given cleaning cycle.

1 Claim, 2 Drawing Figures

PHOTORECEPTOR DESCUMMING DEVICE

Figure 1:
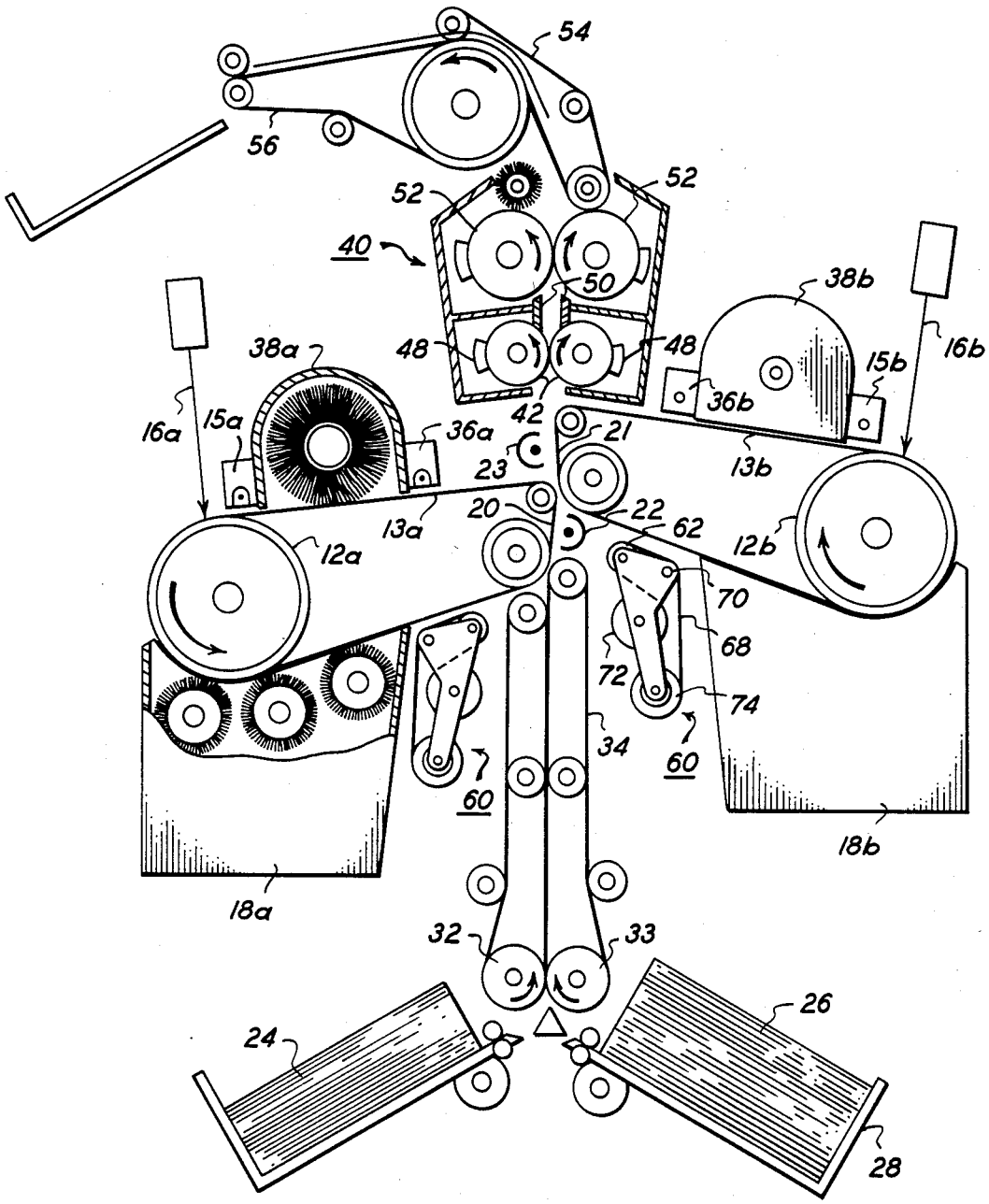

This invention relates to a printing machine photoreceptor surface cleaning apparatus and specifically to apparatus adapted to automatically clean a photoreceptor surface with a web of fibrous material.

The formation and development of images on a photosensitive surface is well known. A photoconductive member is charged to a substantially uniform potential to sensitize the surface. The charged portion of the photoconductive surface is exposed to a light image to record an electrostatic latent image on the photoconductive surface. After the recording of the latent image, the latent image is developed by bringing a developer mixture of carrier granules and toner particles into contact with the surface.

Frequently, residual toner particles as well as other grit and foreign particles remain adhered to the photoconductive surface. After the transfer of the toner powder image to a copy sheet and during the general operation of the machine, toner particles and any other residual particles have been cleaned from the photoconductive surface by various techniques such as employing a cleaning roll in contact with the photoconductive member for removing the particles.

The prior art is replete with systems for cleaning residual toner from a photoconductive surface. For example, U.S. Pat. No. 2,832,977 to L. E. Walkup et al. and U.S. Pat. No. 3,278,917 to Hudson et al. disclose brush rollers for cleaning particles from a photoconductive member. Hudson U.S. Pat. No. 3,807,853 discloses a polyurethane foam roller for cleaning the photoconductive member and U.S. Pat. No. 3,552,850, Royka et al., shows a blade type dry toner cleaning apparatus.

Other cleaning apparatus is disclosed in U.S. Pat. No. 3,781,107 to Ruhland wherein an endless loop cleaner in the form of a web or belt is transported over an area of sweeping engagement with the imaging surface in a direction transverse to the longitudinal dimension of the imaging surface and U.S. Pat. No. 4,230,406 to Klett shows the photoconductive member deflected into engagement with a particle cleaner in response to the photoconductive member advancing along a predetermined path.

In addition, U.S. Pat. No. 4,110,035 discloses a pressure member holding a portion of a flexible web in engagement with a photoreceptor surface to remove the contaminants therefrom, and U.S. Pat. No. 3,615,397 shows a method for cleaning a surface on which electrostatic latent images are formed. In particular, a web of fibrous material is advanced in constant linear increments into rubbing contact with the surface to be cleaned. A combination of loops in the web path enables cleaning two surfaces simultaneously utilizing both sides of the web. U.S. Pat. No. 4,174,172 describes method and apparatus for moving a surface in one direction relative to a cleaning blade in engagement therewith. Rest periods are provided of no relative motion wherein the blade is moved out of contact with the surface at a first position during the period of no relative motion. The blade is returned to the surface at a second position downstream of the first position.

Finally, U.S. Pat. No. 3,848,993 shows an electrostatographic cleaning system for cleaning dry toner from a photoreceptor surface comprising a sharp edged elastomer cleaning tip held in chiseling engagement against the photoreceptor. The tip is integrally mounted on a main blade portion and the main blade portion is cantileverly mounted parallel to and into the direction of movement of the photoreceptor surface.

Generally, most of the prior art systems are concerned with cleaning of residual toner from the photoreceptor surface. There is, however, often a need to clean or scrub the photoreceptor periodically to remove film or scum. Many times this is done by a service representative retracting several subsystems in the printing machine away from the photoreceptor in order to pull the photoreceptor out from the machine cavity for manual scrubbing with pumice or similar cleaning agents. During this manual cleaning operation, there is also often the risk of accidental photoreceptor damage. It is not uncommon to have to perform this cleaning operation approximately three times during the life of the photoreceptor. In addition, extracting the photoreceptor from the cavity of the machine and manually scrubbing the photoreceptor can be very time consuming. In order to save time in a high volume operation, the service representative sometimes will simply put in a new photoreceptor belt rather than clean the old one. This can add significantly to the cost of operation of the machine.

It would be desirable, therefore, to provide a photoreceptor descumming device that can be actuated by the operator from outside the machine for periodic cleaning and descumming of the photoreceptor surface without removal of the photoreceptor from the machine.

It is, therefore, an object of the present invention to provide a new and improved photoreceptor cleaning device. It is a further object of the present invention to provide a photoreceptor descumming device that can be automatically actuated by the operator. It is still a further object of the present invention to provide a photoreceptor descumming device that can be pivoted into engagement with the photoreceptor for cleaning and pivoted out of engagement with the photoreceptor during normal machine operation. It is still another object of the present invention to provide a photoreceptor descumming device including supply and take-up spools of a web cleaning material that is periodically in engagement with the photoreceptor for descumming and cleaning.

Further objects and advantages of the present invention will become apparent as the following description proceeds and the features of novelty characterizing the invention will be pointed out with particularly in the claims annexed to and forming a part of this specification.

Briefly, the present invention is an apparatus for cleaning contaminants from a photoreceptor surface including pivot means for moving a flexible web into engagement with the photoreceptor surface. A supply station stores an unused portion of the web and a receiving station accepts the used portions of the web having contaminants thereon removed from the photoreceptor surface. The web is advanced from the supply station to the receiving station in order that successive portions of the web engage the photoreceptor surface. The pivot means moves the cleaning web into engagement with the photoreceptor surface upon operator actuation and automatically out of engagement after a given cleaning cycle.

Figure 2:
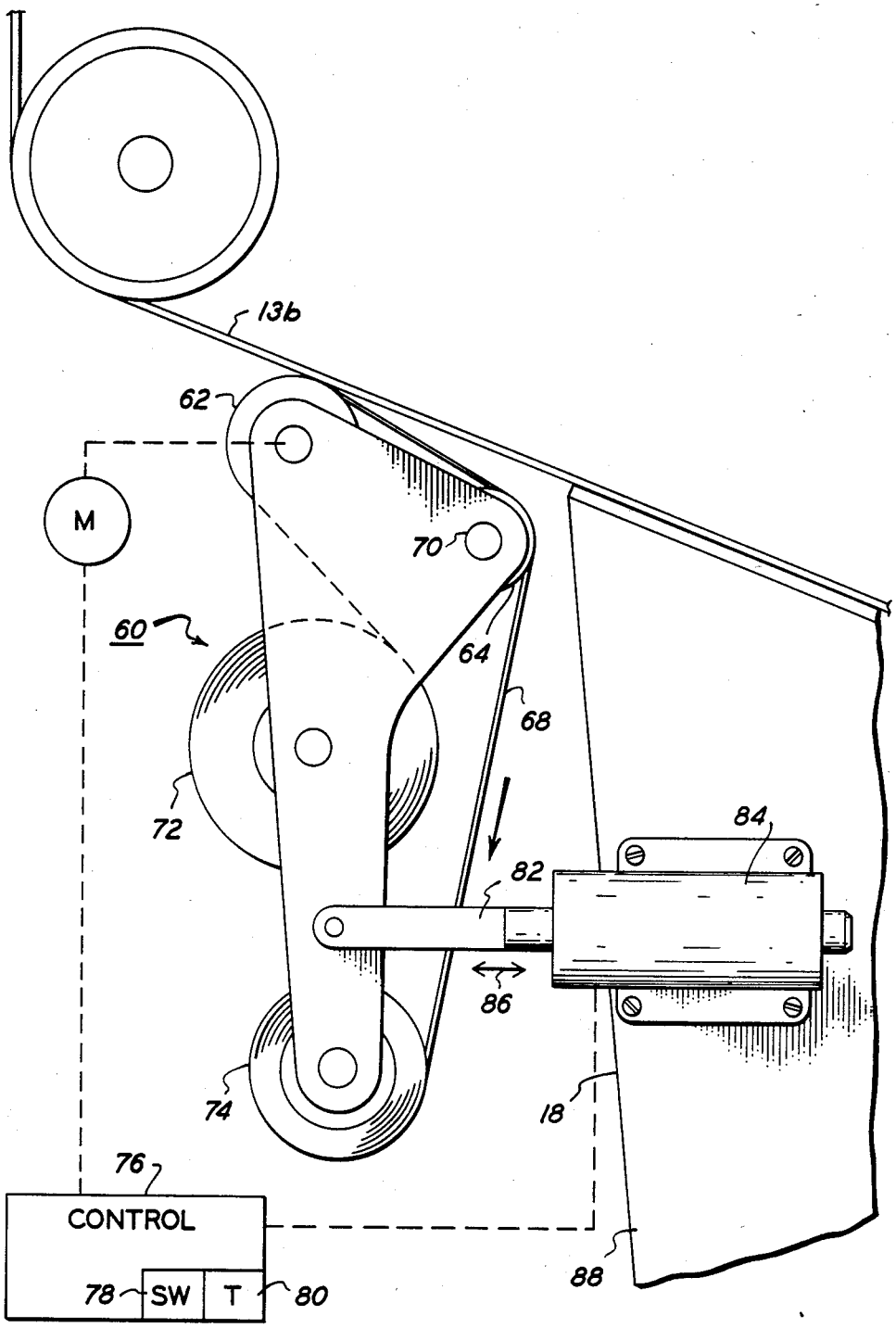

For a better understanding of the present invention, reference may be had to the accompanying drawings wherein the same reference numerals have been applied to like parts and wherein:

FIG. 1 is a schematic representation of an exemplary reproduction apparatus incorporating the cleaner of the present invention; and FIG. 2 is the cleaner of FIG. 1 shown in detail.

Referring to FIG. 1, there is shown by way of example an electrostatographic printing apparatus incorporating the cleaning system of the present invention. Portions of the machine are duplicate xerographic processes. In particular, there is shown a pair of photoreceptor belt subsystems including belt drive rolls 12*a* and 12*b* for advancing belts 13*a* and 13*b* through various xerographic processing stations. At charging corotrons 15*a* and 15*b*, a uniform electrostatic charge is deposited on the respective photoreceptor belts 13*a* and 13*b*.

At image paths 16*a* and 16*b*, an image is projected onto the belts 13*a* and 13*b*. Image projection can be through a system of optical components such as lenses and mirrors in the normal electrophotographic exposure method or through some other technology such as pin arrays, print heads or laser output markers. After image projection, the belts 13*a* and 13*b* rotate in the direction of the arrows to the developers 18*a* and 18*b*. At the developers 18*a* and 18*b*, developing material is brushed over the belt surface in order for toner particles to adhere to the latent electrostatic image to form visible toner image of the image to be reproduced.

Belt 13*a* then rotates to transfer station 20 and belt 13*b* rotates to transfer station 21 for electrostatically transferring toner images from the belts 13*a* and 13*b*, respectively, to a transfer material or copy sheet. Transfer and detack corotron 22 is illustrated at transfer station 20 and transfer and detack corotron 23 is illustrated at transfer station 21.

In a preferred embodiment, however, it should be noted that detack corotrons will not be required. There should be "self-stripping" of copy sheets from the belts 13*a* and 13*b* for papers as light as 16–18 lbs. even under low humidity conditions and with no toner at the lead edges. In the event that detack corotrons are needed, detack corotrons can be accommodated.

Copy sheet supply stations 24 and 26, each containing a stack of copy sheets are provided to supply sheets of a predetermined size. A movable paper shelf 28 is adjusted to the appropriate copy sheet paper size. The copy sheets are delivered one at a time to the nip of the pretransfer rolls 32, 33 to be conveyed by the pretransfer paper transport 34 to the transfer stations 20 and 21. After transfer of an image to a copy sheet, the belts 13*a* and 13*b* continue rotation to the preclean corotrons 36*a* and 36*b* and cleaning stations 38*a* and 38*b* at which the belt is brushed to remove residual toner particles remaining after image transfer.

There is provided a fuser station 40 to simultaneously fix images to both sides of the copy sheet. In particular, a first image is transferred to one side of the copy sheet at transfer station 20. After transfer of the first image, the copy sheet self-strips from the photoreceptor belt 13*a*. The copy sheet immediately enters the transfer zone of photoreceptor belt 13*b* and a second image is transferred to the second side of the copy sheet at transfer station 21. The copy sheet self-strips from belt 13*b*.

Immediately after the transfer station 21, the copy sheet is conveyed into the nip of two toner compacting rolls 42. Preferably, the rolls are adiabatic pressure rolls and can be positioned close to the photoreceptor belt 13*b*. The compacting rolls 42 can be operated at a moderate pressure since the rolls are not intended for fixing of the image. Compacting rolls 42 transport the paper at constant velocity away from the transfer station 21 and compact and tack the toner onto the paper.

To prevent toner offsetting onto rolls 42, wipers 48 deposit a thin film of release agent onto the rolls 42 while wiping them. The paper with the tacked toner images enters the nip of heated soft fuser rolls 52. The fuser rolls 52 operate at slightly lower peripheral velocity than compacting rolls 42 to prevent any erratic velocity feedback to rolls 42. After fixing the toner images to the copy sheet by fuser rolls 52, the copy sheet exits the fuser station 40. It is then conveyed by suitable transports 54 and 56 to a tray or bin.

In accordance with the present invention, with respect to FIGS. 1 and 2 there is illustrated at 60 identical photoreceptor cleaning devices. Each of the devices is an identical online device for the removal of films or scum from the photoreceptor surface 13*a*, 13*b*, respectively. With reference to cleaning device 60, a drive system, including driver 62, driven by motor M, roller 64, supply roll 72 and take up roll 74 is used to drive a cleaning web 68 which preferably contains pumice or a similar cleaning agent.

Under normal printing conditions, the cleaning web 68 is not in contact with the photoreceptor surface 13*b* as seen in FIG. 1. However, after film or scum has been deposited on the photoreceptor surface over a period of time, the cleaning device 60 is actuated to pivot around pivot point 70. This pivoting action brings the cleaning web 68 into gentle contact with the moving photoreceptor surface 13*b* as illustrated in FIG. 2.

After a predetermined number of photoreceptor revolutions, the device 60 is automatically retracted away from the photoreceptor surface 13*b*. This is done by again pivoting the cleaning device 60 about pivot point 70. To continually provide clean portions of the cleaning web 68 for engagement with the photoreceptor surface, the supply roll 72 and the take up roll 74 are provided. For each activation of the cleaning device 60 into engagement with the photoreceptor surface 13*b*, the supply and take up rolls 72 and 74 are activated to provide a fresh portion of cleaning web in engagement with the photoreceptor surface 13*b*.

FIG. 2 illustrates a control 76 including any suitable switch 78 to activate the cleaning device 60 for pivoting about pivot point 70 into engagement with the photoreceptor surface 13*b*. Preferably, the switch 78 is suitably mounted on a control panel for easy access by the operator.

Upon actuation of the switch 78, any suitable pivot mechanism can be used to drive and retract the cleaning device 60 into and out of contact with the surface 13*b*. For example, FIG. 2 illustrates a solenoid activated pivot arm 82 driven back and forward within the housing 84 in the direction of arrows 86. The housing 84 is rigidly secured to a portion of the printing machine frame 88.

Once the switch 78 has been activated, a suitable timer 80 included in the control 76 will time out to automatically return the cleaning device 60 from engagement with the surface 13*b* to a location out of contact with surface 13*b* as shown. It should be noted that any suitable control circuitry may be provided to switch the cleaning device into engagement with the photoreceptor surface 13*b* and to activate the supply and take up rolls 72, 74 of the cleaning web 68. It should also be noted that preferably, although the cleaning device will automatically retract or pivot about the pivot point 70 away from the photoreceptor surface 13*b* upon actuation of switch 78, another switch or manual actuation could be provided for retraction of the cleaning web 68.

In operation, it is anticipated that there could be as many as 200 cleaning cycles to increase the life expectancy of the photoreceptor surface. However, any number of cleaning cycles could be contemplated in the cleaning device of the present invention in order to extend life expectancy.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. Apparatus for cleaning contaminants from a photoreceptor surface including a flexible web engagable with the photoreceptor surface during the operation of the photoreceptor surface, a supply station including a first spool storing an unused portion of the web, a receiving station including a second spool for accepting a used portion of the web having thereon contaminants removed from the photoreceptor surface, means for advancing the web from the supply station to the receiving station in order that successive portions of the web engage the photoreceptor surface, pivot means, the web supported by the pivot means for moving the web into and out of engagement with the photoreceptor surface, control means including a switch to selectively activate the pivot means during the operation of the photoreceptor surface, and a timer responsive to the switch to selectively retract the flexible web from engagement with the photoreceptor surface a given period of time after activation of said switch.

* * * * *